US006739025B2

(12) United States Patent
Hu et al.

(10) Patent No.: US 6,739,025 B2
(45) Date of Patent: May 25, 2004

(54) METHOD OF IMPROVING PROPERTIES OF OPEN END YARN

(75) Inventors: Jinlian Hu, Kowloon (HK); Xiuying Jiang, Kowloon (HK)

(73) Assignee: Hong Kong Polytechnic University, Kowloon (HK)

( * ) Notice: Subject to any disclaimer, the term of this patent is extended or adjusted under 35 U.S.C. 154(b) by 0 days.

(21) Appl. No.: 09/995,859

(22) Filed: Nov. 29, 2001

(65) Prior Publication Data

US 2002/0148087 A1 Oct. 17, 2002

Related U.S. Application Data

(63) Continuation-in-part of application No. 09/776,915, filed on Feb. 6, 2001, now abandoned.

(51) Int. Cl.[7] ..... D02J 1/22
(52) U.S. Cl. ..... 28/246; 57/1 UN
(58) Field of Search ..... 28/246, 245, 240, 28/282, 283, 219, 220, 218, 243, 244, 271; 57/1 UN, 2.3, 310, 350

(56) References Cited

U.S. PATENT DOCUMENTS

| | | | | | |
|---|---|---|---|---|---|
| 2,219,357 | A | * | 10/1940 | Dreyfus et al. | 57/2.3 |
| 2,450,045 | A | * | 9/1948 | Jackson et al. | 28/246 |
| 2,807,863 | A | * | 10/1957 | Schenker | 28/246 |
| 2,918,346 | A | * | 12/1959 | Paulsen | 28/283 |
| 3,380,131 | A | * | 4/1968 | Gray | 28/246 |
| 3,611,522 | A | * | 10/1971 | Daniels et al. | 28/246 |
| 3,703,075 | A | * | 11/1972 | Bose | 57/1 UN |
| 3,930,292 | A | * | 1/1976 | Schippers et al. | 28/246 |
| 3,944,166 | A | * | 3/1976 | Hermanns | 28/290 |
| 4,035,883 | A | * | 7/1977 | Bond | 28/246 |
| 4,318,210 | A | * | 3/1982 | Foster et al. | 28/246 |
| 5,558,825 | A | * | 9/1996 | Ueda et al. | 57/350 |
| 6,263,882 | B1 | * | 7/2001 | Chehab et al. | 28/246 |

* cited by examiner

*Primary Examiner*—A. Vanatta
(74) *Attorney, Agent, or Firm*—Leydig, Voit & Mayer, Ltd.

(57) ABSTRACT

Open end yarn is passed through a drawing zone located between a front roller and a back roller controlled to rotate at different velocities. An air jet nozzle is located between the two rollers and directs a jet of air at the yarn. The drawing improves various characteristics of the yarn, making the processed yarn more suitable for making textile articles.

1 Claim, 6 Drawing Sheets

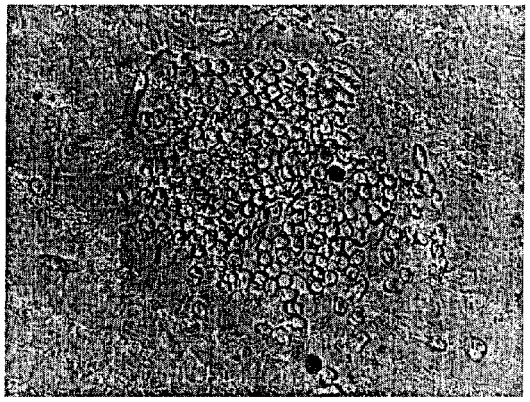
Before Drawing
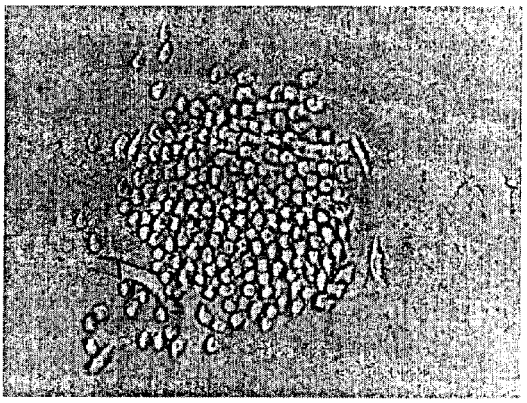
After Drawing
Fig. 6 Yarn Packing Density Comparison

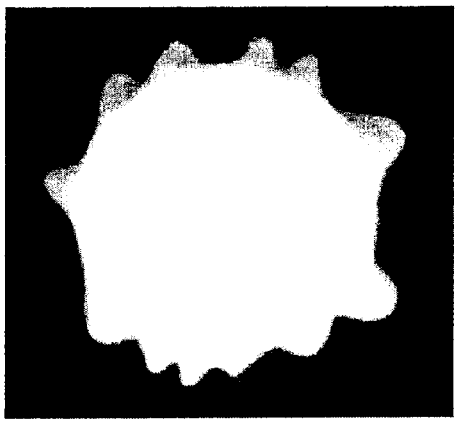
Produced from untreated yarn
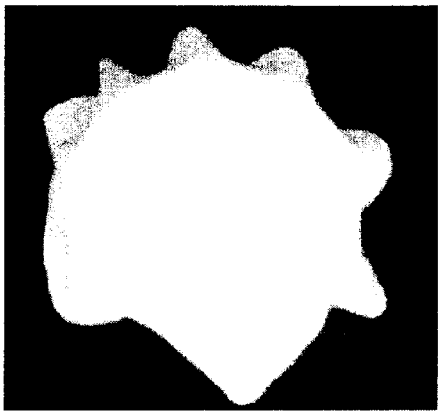
Produced from drawn yarn
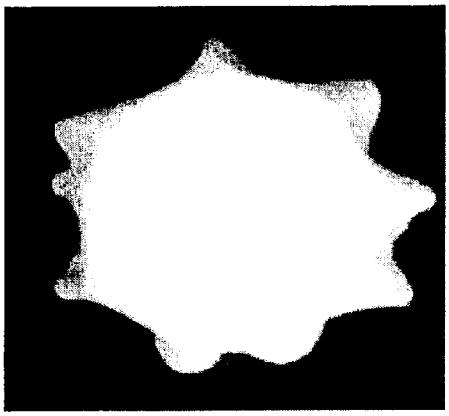
Produced from untreated yarn
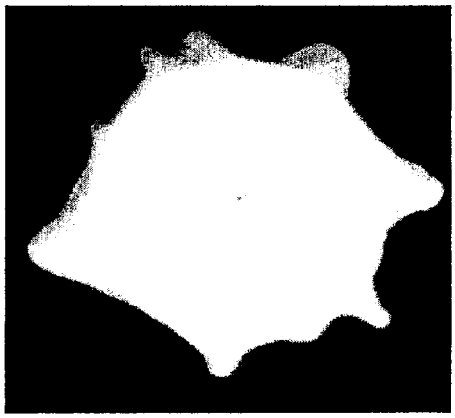
Produced from drawn yarn
Fig.7 Drape Image of Sample Fabrics

METHOD OF IMPROVING PROPERTIES OF OPEN END YARN

This patent application claims the benefit of non-provisional U.S. patent application Ser. No. 09/776,915, filed Feb. 6, 2001, now abandoned, which is incorporated by reference.

BACKGROUND OF THE INVENTION

1. Field of the Invention

The invention relates to open end yarn processing and its fabric properties.

2. Description of Prior Art

The invention relates to a method and apparatus which are suitable for processing on open end (OE) spinning systems, and is more particularly concerned with rotor spinning system and downstream processing on such systems.

The open end spinning system has achieved a major breakthrough because the twist insertion in this spinning system is no longer performed by the rotation of yarn packages and thus this system eliminates the friction problem that limits ring-spinning. As a result, OE spinning techniques have had a phenomenal growth in productivity, due to amenability to automation, and elimination of roving and winding processes. Therefore, this technique has established itself as a worthy alternative to the ring spinning system. alternative to ring spinning system.

However, OE spun yarns have not penetrated the yarn market to the extent expected because along with the positive aspects there is a growing realization that the system has sectorial applicability-viz, the techo-economic considerations have restricted rotor spinning to coarse and medium counts. These demerits made this new system less attractive than ring spinning technique, which can handle a diversity of fibers and produce a broad range of yarn counts. What is more, the OE spun machine produces a weaker yarn, usually with a 10–30% lower tenacity, as compared to ring spinning. This strength loss is related to the accentuated obliquity effect and higher proportion of noncontributing fibers existing in an OE spun yarn.

However, the biggest drawback of OE yarns is the harsh feel of the fabrics made out of such yarns. Particularly, the harsh feel limits the end use of its end fabrics. For example, knitted fabrics produced from OE spun yarns are unsuitable for using as underwear material. The harsh feel can be attributed to the structure of the yarn, and especially to that of the surface fibers. In particular, it is believed that the tight surface fibers, including wrapper fibers and undulation of the yarn surface, are assumed to be the main cause of harsh feel. Besides, the higher twist adopted in OE yarn and thus higher obliquity of fibers is another significant influential factor. Moreover, fabric produced from OE yarn suffers from a duller appearance, which is also undesirable for end use.

It is therefore an object of the present invention to provide a method and an apparatus for improving OE yarn/fabric structural properties, modifying yarn physical properties, and altering the appearance and handling properties of fabrics made out of rotor spun yarn.

SUMMARY OF THE INVENTION

It is an object of this invention to overcome or at least reduce this problem.

According to the invention there is provided a method for improving structural and physical properties of open end yarn and articles made of open end yarn, including tensile drawing the yarn between rollers driven at different velocities and directing a jet of air at the yarn between the rollers to temporarily untwist the yarn as it is drawn.

An apparatus for improving structural and physical properties of open end yarn and articles made of open end yarn, comprises at least two rollers which are separated by a drawing zone, in which the rollers are controlled to rotate at different velocities to apply tension to the open end yarn as the open end yarn passes through the drawing zone and an air jet directed at the drawing zone to temporarily untwist the yarn as it is drawn.

BRIEF DESCRIPTION OF THE DRAWINGS

The method according to the invention will now be described by way of example with reference to the accompany drawings in which:

FIG. 6 shows yarn packing density before and after tensile drawing; and

FIG. 7 shows drape images of fabric samples.

DESCRIPTION OF THE PREFERRED EMBODIMENTS

Figure 1:
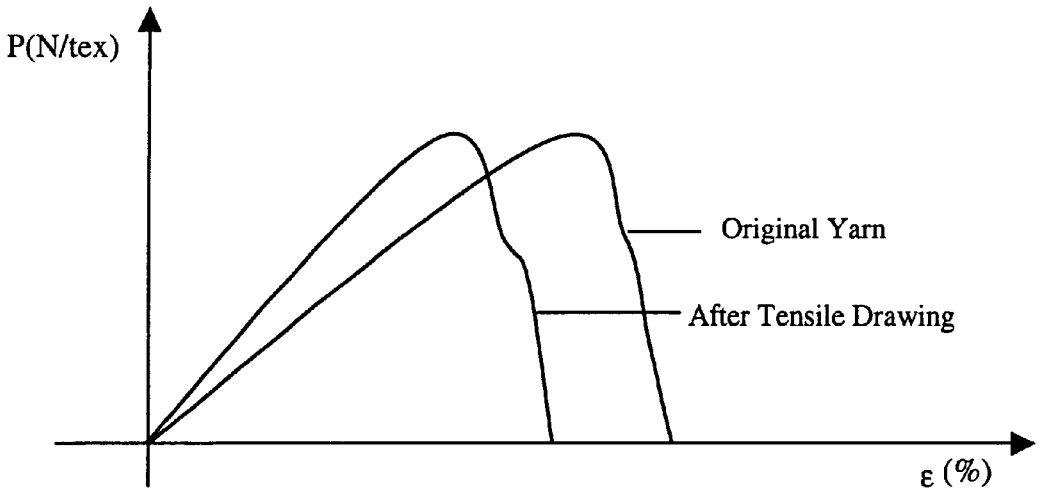
FIG. 1 is a stress-strain diagram including yarns before and after tensile drawing.
Figure 2:
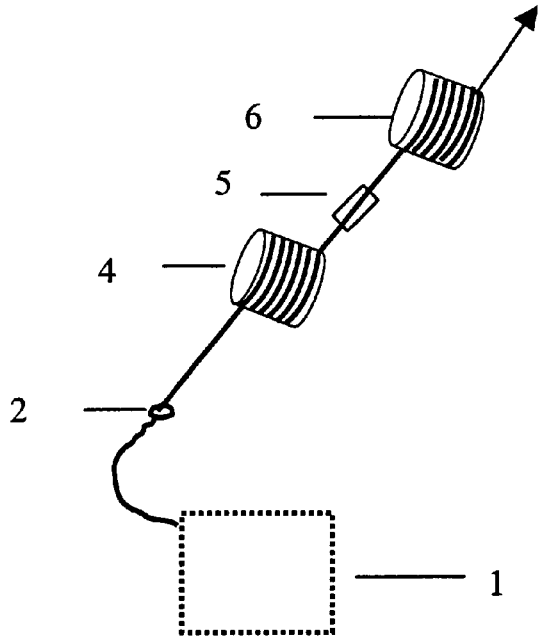
FIG. 2 is another schematic illustration of apparatus for carrying out the method.
Figure 3:
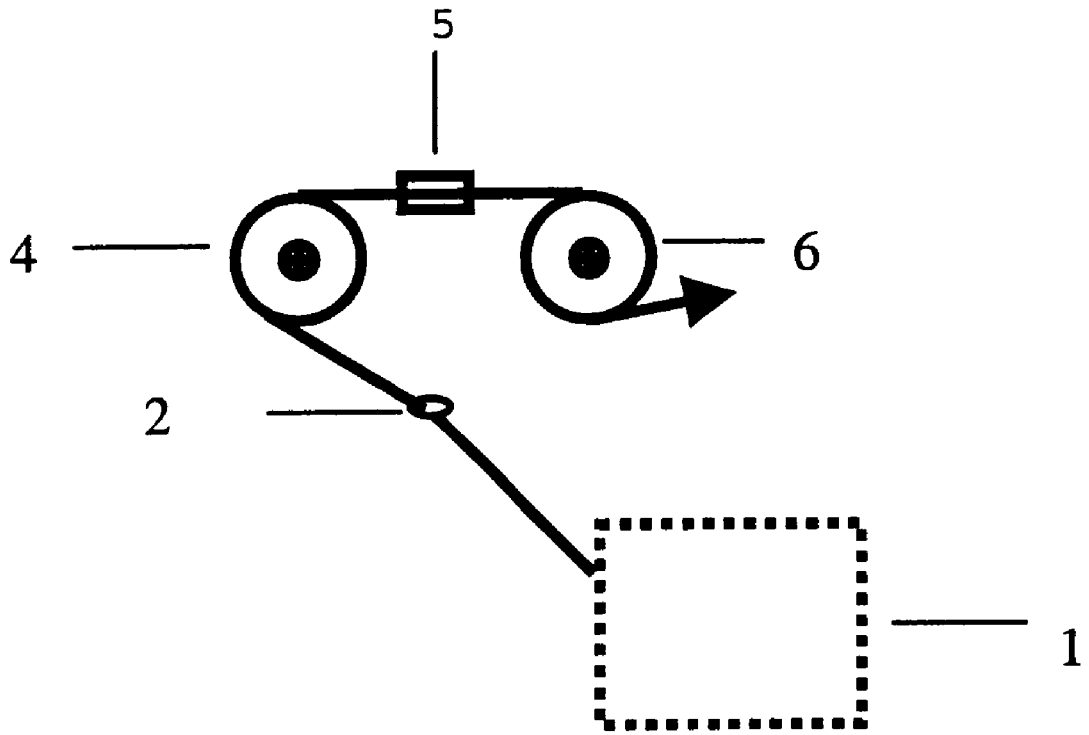
FIG. 3, is another a schematic illustration of the apparatus shown in FIG. 2.

Referring to the drawings, FIG. 1 shows stress strain diagram of yarn before and after drawing. In FIGS. 2 to 5, various illustrations of apparatus are shown, each involving a two-roller drawing system with an air jet nozzle located between the two rollers. In this two-roller drawing system, the back roller always runs at a speed lower than the front roller, and thus the rotor spun yarn is under tensile load when passing through these two rollers. The drawing ratio is equal to the ratio of front roller velocity to back roller velocity. However, it should be noted that in practice this drawing ratio does not represent the real extension of the generated rotor spun yarn and is only a nominal one. For example, in the case of a 16s pure cotton rotor spun yarn under a drawing ratio of 1.2, the actual elongation is at a value of 2%–3%. In some instances the effective elongation may be zero (or even negative). On the other hand, however, the extension can be as high as, say, 15% for 20 yarn under the same drawing ratio. Therefore, the actual extension should be related to yarn count and other parameters as well as drawing ratio. Embodiments of the invention preferably operate to provide certain advantages, generally stated, over original yarn under velocity ratios R ranging from $1.01<R<1.4$. The adoption of the air jet nozzle can subject the OE yarn to the action of a temporary false twisting between the rollers to improve the tensile drawing effect.

Figure 4:
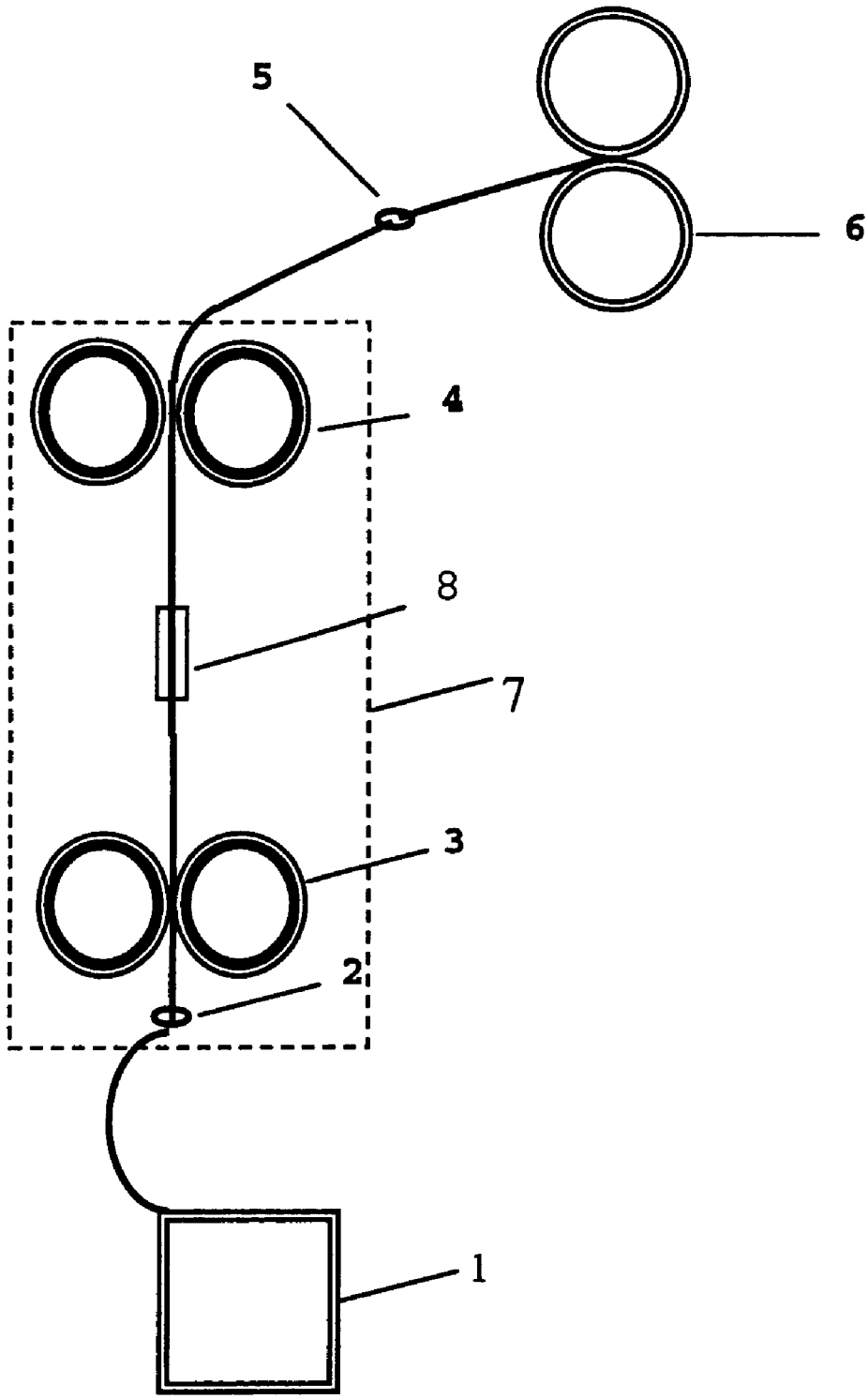
FIG. 4 is a working representation of tensile drawing apparatus attached to a spinning system.
Figure 5:
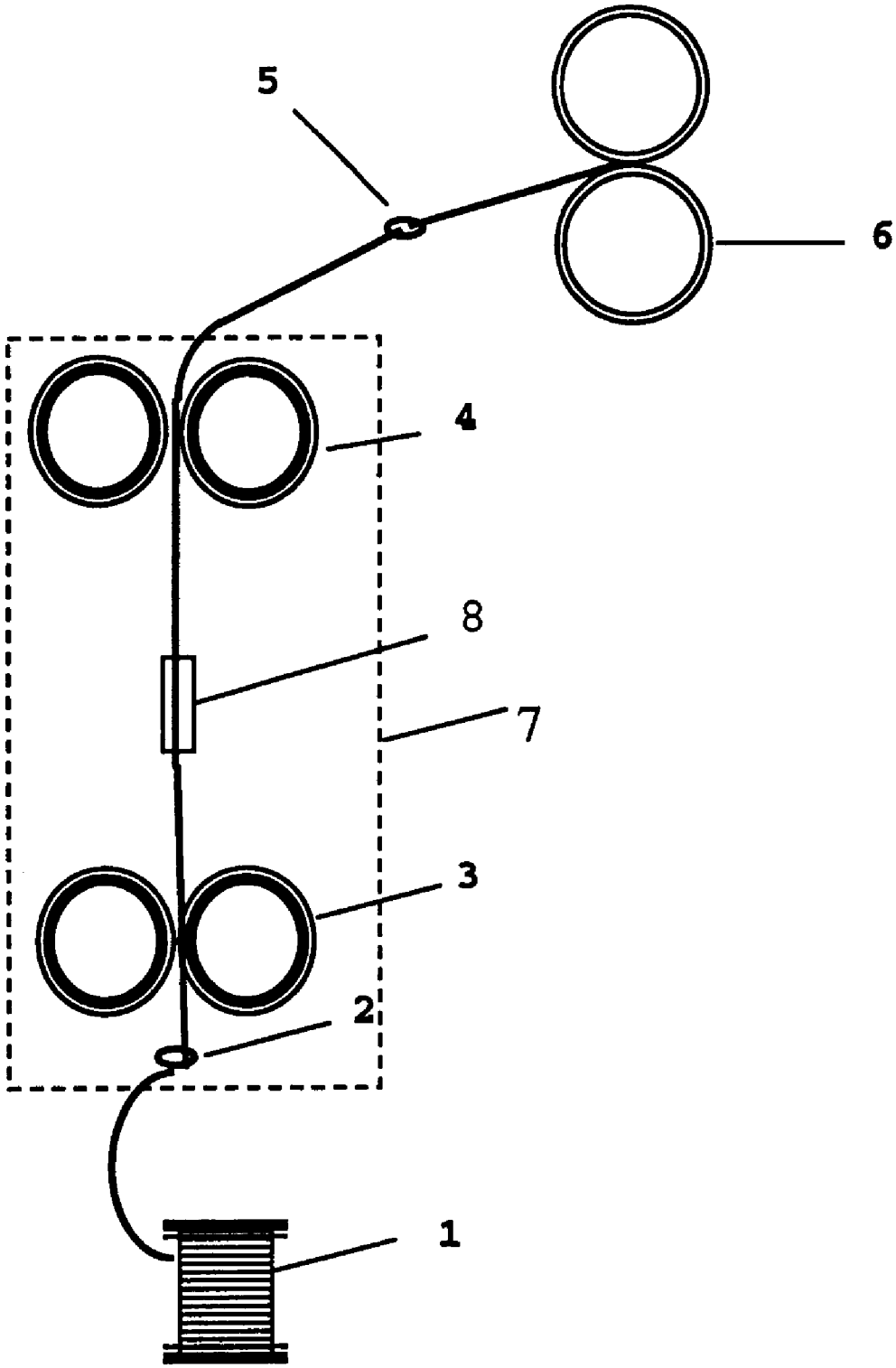
FIG. 5 is a working representation of tensile drawing apparatus attached to a rewinding system.

In the present apparatus, OE yarn, after withdrawing from a bobbin or a spinning system as shown in FIG. 4 is fed by back roller 3 via a drawing zone 7 to a front roller 4. The air jet nozzle 8 directs a jet of air at the yarn in the drawing zone. The yarn then passes via a thread guide 5 to a traversing guide (not shown) and is wound on a bobbin 6. After completing this tour, the yarn has undergone tensile drawing due to the velocity difference between the front roller 4 and the back roller 3. The air jet from nozzle 8 temporarily removes twist in the yarn to assist tensile drawing yet retain the basic twist in the drawn yarn as the twist will return once the yarn exits the air jet stream.

Among various open end spinning techniques, rotor spinning system is most widely practiced. Therefore, in the described embodiments rotor spun yarn is used and results of this type of yarn are illustrated. Up to 18 yarn types with a combination of 4 yarn counts, 4 twist factors, as well as four drawing ratios are involved, although only certain facets are illustrated to show the unexpected and positive results:

1. Yarn Properties

Yarn Diameter & Evenness

In the present invention, improvement in yarn structural properties can be attained using tensile drawing processing. Yarn diameter shows a pronounced decrease after tensile drawing processing despite of the subtle variation in yarn count. The set out in Table 1, which presents a good support to this conclusion, is the resulting properties of 16s pure cotton rotor spun yarns with a twist factor 3.6, 4.2 respectively under the drawing ratio of 1.2. Besides, a better evenness, i.e. lower yarn diameter variation, another benefit from tensile drawing, is also shown in Table 1.

TABLE 1

| Properties of the resulting yarns | Yarn Diameter: Twist Factor = 3.6 Turns/meter | | Twist Factor = 4.2 | |
|---|---|---|---|---|
| | Original | Drafted | Original | Drafted |
| Mean value mm. | 4.28 | 2.935 | 4.155 | 3.225 |
| S +/− | 0.621 | 0.412 | 0.625 | 0.436 |
| CV % | 14.514 | 14.038 | 15.050 | 13.530 |
| Min. Value | 3.3 | 2.3 | 3.2 | 2.6 |
| Max. Value | 5.5 | 3.5 | 5.6 | 4.5 |
| Med. | 4.3 | 3.0 | 4.1 | 3.1 |

Yarn Twist

Tensile drawing would no doubt lead to a decrease in yarn twist. In the case of a staple spun yarn, twist is closely related to the magnitude of fiber-to-fiber gripping force, to the degree of yarn hairiness, to the extent of fiber obliquity effect, and to the number of fiber in yarn cross section (i.e. packing density). Therefore, the change in yarn twist deserves special attention. It's believed that this cut down in yarn twist would contribute to better luster of the downstream articles due to the more uniform light reflection caused by decreased fiber obliquity effect. And this is the reason of better whiteness for the generated fabric.

TABLE 2

| Properties of the resulting yarns | Yarn Twist: Twist Factor = 3.6 | | Twist Factor = 4.2 | |
|---|---|---|---|---|
| | Original | Drafted | Original | Drafted |
| Mean value | 551.6 | 539.8 | 616.6 | 616.4 |
| S +/− | 14.894 | 5.706 | 18.575 | 8.890 |
| CV % | 2.700 | 1.057 | 3.013 | 1.442 |
| Min. Value | 531 | 534 | 598 | 601 |
| Max. Value | 572 | 550 | 641 | 627 |
| Med. | 550 | 539 | 607 | 616 |

Packing Density

A remarkable increase in cross section packing density can be found after tensile drawing using Microtomy technique, as presented in FIG. 6. This packing-density-increase phenomenon under tensile load has been noticed by G. A. Carnaby, who named this phenomenon as fiber lateral movement. It is said in his related publication that a staple-fiber yarn usually consists of fibers that are initially packed together in a rather loose arrangement and that an applied tensile strain causes considerable lateral movement of individual fibers, so that the deformed yarn has a much more closely packed structure. Apparently, such lateral movements will considerably influence the strain levels in individual fibers and thus change the strain distribution of deformed yarn. As a result, the mechanical properties of treated yarn are also distinctly changed. Moreover, this change will be brought into the end product when the treated yarn is produced into fabric. The wear performance as well as mechanical properties of the end product will thus be changed accordingly.

Young's Modulus

This structural change leads directly to a great change in yarn physical properties. The first sight of stress-strain diagram (see FIG. 1) gives a prompt information that Young's modulus, a measure of yarn resistance to tensile drawing, which is indicated by image slope, presents a distinct increase. This is caused by plastic deformation occurring during the tensile drawing processing. In fact, in addition to Young's modulus, i.e. the yarn's ability to resist other deformation, such as bending and torsion, is enhanced as well. This can be verified by the change in fabric structural properties.

Tenacity

Despite increase in tenacity being quite subtle and not so consistent, some of the processing conditions on a certain kind of yarns, usually those with lower twist factors, do contribute to somewhat stronger yarn. This can be explained by a combination of decreased obliquity effect, increased packing density, and a cut-down in a proportion of noncontributing fibers due to tensile drawing.

Hairiness

More hairiness is inherently unavoidable due to decreased twist created by tensile drawing. This may not be a demerit, because rotor spun yarns are lacking in hairiness due to the existence of wrapped fibers around the yarn surface. This increase in yarn hairiness may help to improve tactile feel of the end fabric.

2. Fabric Properties

Using the tensile drawn yarn for a downstream fabric leads to better appearance and physical properties in the following aspects:—

Fullness & Softness

Fukurami, a measure of fabric softness and fullness, a bulky, rich, and well-formed feeling and mainly governed by fabric bulk and compressional behavior, has acquired the most positive progress according to whichever standard, knitted fabrics for outerwear or underwear in summer or in winter. The set out in the following series of tables presenting three selected primary hands and the total hand value gives a good support of this conclusion.

Tactile Comfort

The fabrics produced from drawn rotor spun yarns, as compared with those from undrawn rotor spun yarns, shows significant improvement on hand values. The normal harsh feel of undrawn rotor spun yarn fabric is prominently changed according to the results. THV, a measure of tactile comfort, shows different extents of increase in most cases. This is a major benefit provided by embodiments of the invention.

TABLE 3

| Knitted Fabrics for Outerwear | | | | |
|---|---|---|---|---|
| Sample | KM-402-KT | | | KM-301-WINTER (KT) |
| No. | KOSHI | NUME. | FUKU. | THV |
| 1 | 0.51 | 5.51 | 3.83 | 1.64 |
| 2 | 0.97 | 6.59 | 7.84 | 2.60 |

TABLE 4

| Knitted Fabrics for Underwear in Winter | | | | |
|---|---|---|---|---|
| Sample | KM-403-KTU (WINTER) | | | KM-304-WINTER |
| No. | KOSHI | FUKU. | NUME. | THV |
| 1 | 6.65 | 1.92 | 4.78 | 2.83 |
| 2 | 6.65 | 8.56 | 4.42 | 3.34 |

TABLE 5

| Knitted Fabrics for Underwear in Summer | | | | |
|---|---|---|---|---|
| Sample | KM-403-KTU (SUMMER) | | | KM-304-SUMMTER |
| No. | KOSHI | FUKU. | SHARI | THV |
| 1 | 6.65 | 1.92 | 6.52 | 2.73 |
| 2 | 6.65 | 8.56 | 4.66 | 2.48 |

Sample numbered 1 and 2 refers to fabrics produced from 18 s undrawn/drawn pure cotton rotor spun yarns, sharing a common twist factor of 3.6 tpi, respectively. Both fabrics have undergone relaxing by scouring.

Shrinkage

Shrinkage of fabrics produced from drawn rotor yarns shows little difference from that of fabrics from undrawn yarns. This is quite encouraging because what the inventors, and also believed the potential users, worry most is whether tensile drawing will result in a deteriorated shrinkage.

Thickness

The fabric thickness in most cases is markedly improved by the tensile drawing, despite a superficial contradiction being that there is a notable decrease in yarn diameter. This revealed a significant increase of yarn bending/torsional rigidity. Higher bending/torsional rigidity results in a more prominent three-dimensional structure of loops and less compression at interlacing points in a made up fabric so as to enhance the fabric thickness.

TABLE 6

| Fabric Thickness & Weight | | | | |
|---|---|---|---|---|
| Properties of | Twist factor = 3.6, 16 s | | Twist factor = 3.6, 18 s | |
| the resulting fabrics | original | DR = 1.2 | original | DR = 1.3 |
| THICKNESS [mm] | 1.0322 | 1.8254 | 1.2874 | 1.3704 |
| WEIGHT [m/cm$^2$] | 31.7500 | 31.2800 | 18.100 | 18.6200 |

DR: drawing ratio

Air Permeability

TABLE 7

| Air Permeability of 12 s Fabric Samples | | | | | |
|---|---|---|---|---|---|
| Fabric sample | 1 | 2 | 3 | 4 | 5 |
| Air Permeability [cc/s] | 112.7 | 90.7 | 97.4 | 93.5 | 101.6 |
| Air Permeability [ml/cm$^2$ · s] | 22.2 | 17.9 | 19.2 | 18.4 | 20 |

Table 7 lists the results of air permeability for all five fabric samples in the described method from 12s yarn, original yarn as well as treated under four drawing ratios. It can be seen that fabrics produced from drawn yarns have a slightly higher air permeability than that from original yarns. This result seems at odds with the fact that drawn yarns possess higher hairiness. The deviation from what might be predicted is believed to be due to crimp levels, a consequence of higher yarn bending/torsional/tensile modulus after drawing. The drawn yarn opens up less than does an untreated yarn, as revealed by yarn cross section examination. Therefore, is the fabric made from drawn yarn tends to be more air-permeable.

Compression

LC, representing the linearity of compression, and RC, the compressional resilience, both depend upon the compressional behavior of yarn and the fabric thickness. WC, compressional energy per unit area, depends upon LC and the extent of compression of the fabric. In this respect, both fabrics produced from drawn yarns shows greater compressional properties in most cases. The increase in a 18s fabric compressional properties is much less than that in a 16s fabric. This difference is believed to be related to the different extent of drawing and thus the generated different amount of yarn diameter decrease, different degree of yarn rigidity increase and different increase pitch in fabric thickness. In the case of a 18s rotor spun yarn, a 1.3 drawing ratio leads to a slimmer yarn, and less rigidity increase than with a 16s yarn under a 1.2 drawing ratio, and thus the increase in thickness is not so prominent as revealed by Table 6. Therefore, the enhancement in compressional properties is quite subtle.

TABLE 8

| Compressional properties | | | | |
|---|---|---|---|---|
| Properties of | twist factor = 3.6, 16 s | | twist factor = 3.6, 18 s | |
| the resulting fabrics | original | DR = 1.2 | original | DR = 1.3 |
| LC [–] | 0.2100 | 0.3072 | 0.4241 | 0.3724 |
| WC [g · cm/cm$^2$] | 0.2366 | 0.4360 | 0.3817 | 0.3877 |
| RC [%] | 22.6140 | 34.6717 | 44.3835 | 44.6352 |

Draping Property

Fabric draping characteristic is a property closely related to the bending rigidity of the constituent yarns and of the fabric itself as well as fabric thickness. It is found that this property reduces significantly after tensile drawing processing (see FIG. 7). This property change is brought about by the increased yarn bending rigidity and confirms the improvement in yarn bending rigidity. Furthermore, the increase in thickness helps a reduction in this property.

The draping property decrease phenomenon is particularly useful since a soft hand is always a concomitant of higher draping property. The described tensile drawing processing enables these two extremely incompatibles to coexist in one fabric. This could lead to new appraisal in fashion design, especially in the case of knitted fabrics. Hitherto, poor drape properties limits application, mainly to underwear and skirting. In any event, this changed property helps for fabric dimension retention.

Appearance

It is well known that rotor spun yarn fabrics generally have a duller and mottled appearance by comparison with ring spun yarn fabrics, even when bright fiber types are used. This is associated with a combination of a peculiar rotor spun yarn surface nature and resulting turbid light refraction. These disadvantages are improved, at least to some extent, by tensile drawing, and believed to be attributable to the improved fiber alignment and fiber structural evenness provided by the described method.

The surprising results and improvements of the yarn that enhance articles ("downstream articles") made up of the yarn after being subjected to drawing can be demonstrated for a wide range of drawing conditions, even where the effective elongation caused by drawing is near zero or even slightly negative. Further, the improvements can be manifested where the OE yearn is mixed or blended with other yarns. Thus, in the claims for example the term OE yarns is to be taken to mean OE yarns and OE blends.

We claim:

1. A method for improving structural and physical properties of open end yarn including:

tensile drawing an open end yarn between each of two pairs of rollers, the pairs of rollers being driven at different velocities; and directing a jet of air at the open end yarn between the two pairs of rollers thereby temporarily untwisting the open end yarn as the open end yarn is drawn.

* * * * *